United States Patent [19]

Efstratis

[11] Patent Number: 4,944,507

[45] Date of Patent: Jul. 31, 1990

[54] EASY GLIDE FUN RIDE

[76] Inventor: Ernest Efstratis, 6775 Wing Lake Rd., Birmingham, Mich. 48010

[21] Appl. No.: 434,367

[22] Filed: Nov. 13, 1989

[51] Int. Cl.[5] ..... A49B 39/00

[52] U.S. Cl. ..... 272/85; 297/273

[58] Field of Search ..... 272/85–91; 297/273–282

[56] References Cited

U.S. PATENT DOCUMENTS

| | | | |
|---|---|---|---|
| 2,539,869 | 1/1951 | Sicklesteel | 272/85 X |
| 2,616,485 | 11/1952 | Robbins | 272/85 X |
| 3,058,744 | 10/1962 | McGuire | 272/85 |
| 3,580,571 | 5/1971 | Green | 272/85 |
| 3,829,086 | 8/1974 | Lelong | 272/85 |
| 4,620,702 | 11/1986 | Hemmeter | 272/85 |

FOREIGN PATENT DOCUMENTS

| | | | |
|---|---|---|---|
| 609676 | 1/1935 | Fed. Rep. of Germany | 272/85 |

*Primary Examiner*—Richard E. Chilcot, Jr.
*Attorney, Agent, or Firm*—Barnes, Kisselle, Raisch, Choate, Whittemore & Hulbert

[57] ABSTRACT

A glider especially for children is provided with a supporting frame having laterally spaced apart uprights. An elongated board between the uprights has a seat portion at each end. The board is suspended by a T-bar from the tops of the uprights for swinging movement in a vertical plane. An elastic member urges the board to a neutral, generally horizontal position.

12 Claims, 1 Drawing Sheet

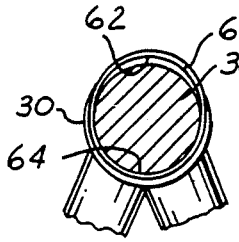
FIG.5
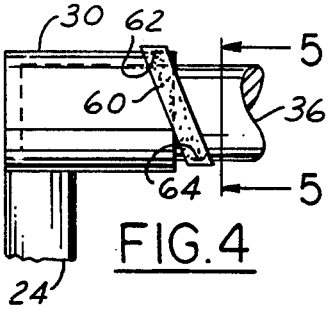
FIG.4
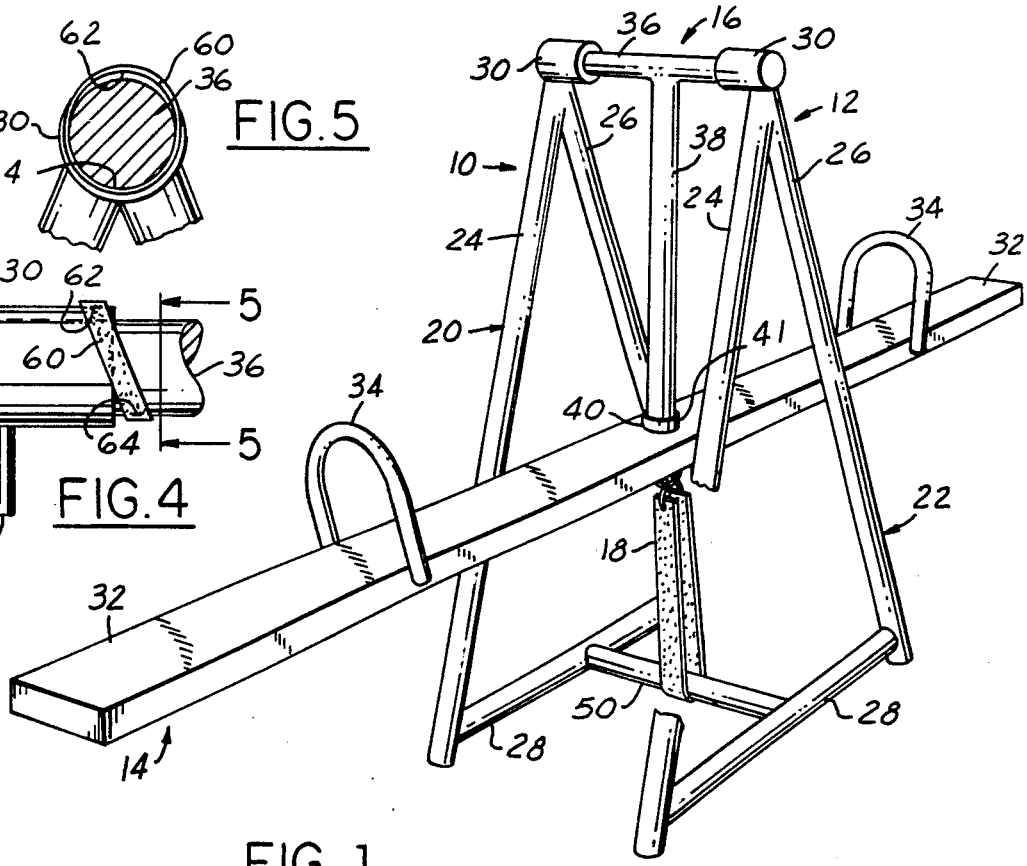
FIG. 1
FIG.2
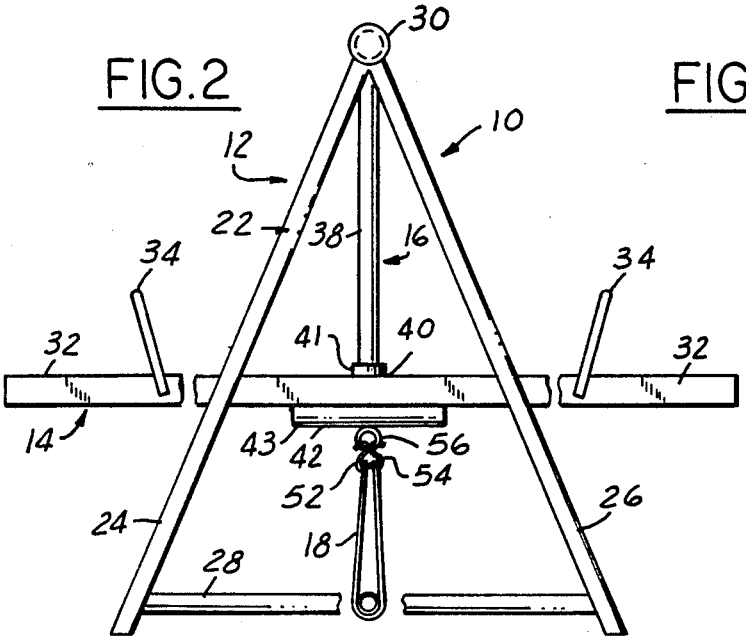
FIG.3
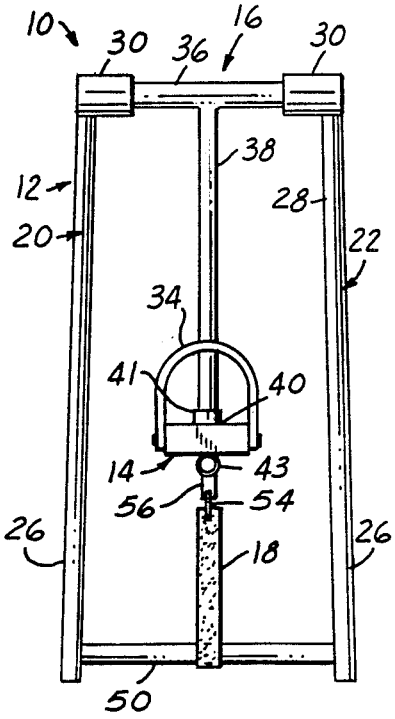

EASY GLIDE FUN RIDE

This invention relates generally to play ground and in house equipment and refers more particularly to a teeter glider.

SUMMARY OF THE INVENTION

The glider of this invention is intended especially for use by children. The glider comprises an elongated board supported between the uprights of a supporting frame for swinging movement in a vertical plane in opposite directions from a neutral, generally horizontal position.

In accordance with a specific embodiment of the invention hereinafter described, the supporting frame has a pair of laterally spaced apart A-frame uprights. Each upright preferably has a pair of legs connected at the top, which diverge downwardly and are spaced apart at the bottom. The bottoms of the legs engage the ground to provide a supporting base. The board is suspended from the supporting frame by means including a T-bar. The cross member of the T-bar engages in bearings at the tops of the uprights for turning movement about a horizontal axis. The central member of the T-bar is connected to the board approximately midway between the ends of the board. The board is urged to a neutral, generally horizontal position by an elastic member, preferably a rubber strap connected at one end to the board and at the other end to a brace at the bottom of the supporting frame.

Objects of this invention are to provide a glider having some or all of the foregoing features, which is inexpensive to manufacture, which provides a smooth glide ride and can be ridden by two children or by one child only.

These and other objects of the invention will become more apparent as the following description proceeds, especially when considered with the accompanying drawings.

BRIEF DESCRIPTION OF THE DRAWINGS

FIG. 1 is perspective view with parts broken away of a glider constructed in accordance with the invention.

FIG. 2 is a side elevational view of the glider shown in FIG. 1.

FIG. 3 is a front view of the glider.

FIG. 4 is a fragmentary view showing a modification.

FIG. 5 is a sectional view taken on the line 5—5 in FIG. 4.

DETAILED DESCRIPTION

Referring now more particularly to the drawings and especially FIG. 1–3, there is shown a glider generally designated by the reference numeral 10 having a supporting frame 12, a glide board 14 suspended from the supporting frame by a T-bar 16, and an elongated resilient strap 18 for centering the board in a neutral, generally horizontal position.

The supporting frame 12 has two laterally spaced apart uprights 20 and 22. The uprights are of identical A-frame construction made of metal or any suitable relatively rigid material. Each upright has two legs 24 and 26 which are connected together at the top and which diverge downwardly in forward and rearward directions. The legs 24 and 26 of each upright are connected adjacent the bottoms by a beam 28. The legs and beams of the uprights are preferably of tubular construction and welded together. In other words, the tops of the two legs 24 and 26 of each upright are welded together, and the ends of the beam 28 are welded to the lower end portions of the legs. Obviously, welding is only one form of connection that may be employed. The parts of each upright may be rigidly connected together by any suitable means such as by nut and bolt connections, for example. The legs and the beam of each upright are straight elongated members all lying in a common plane. The uprights are preferably substantially vertical and parallel to one another.

There is a tubular or cylindrical bearing sleeve 30 at the top of each upright. The bearing sleeves 30 are aligned and horizontal so that they define a horizontal axis at right angles to the planes of the two uprights.

The board 14 is an elongated straight, flat member made of wood or metal or plastic or any suitable relatively rigid material and may, for example, have a thickness of 2 inches, a width of 6 inches, and a length of 8 feet. These dimensions may vary considerably depending upon particular requirements. The end portions of the board provide seats 32 and adjacent each seat is a handle 34 on the top surface of the board spaced from the end of the board in a position where it may be gripped conveniently by a person occupying the seat 32.

The board is suspended from the supporting frame 12 for swinging movement in a vertical plane parallel to the planes of the uprights in opposite directions from a vertical, generally horizontal position by means including the T-bar 16. The T-bar 16 has a cross member 36 and a central member 38, both of which are preferably elongated tubular elements of metal or any suitable relatively rigid material, secured together as by welding at the midpoint in the length of the cross member. The cross member 36 extends horizontally and its ends are journaled for rotation in the bearing sleeves 30 for rotation on the horizontal axis defined by the bearing sleeves. The central member 38 of the T-bar extends at right angles to the cross member and is connected to the board 14 at its midpoint. Specifically, the board has a hole 40 extending therethrough from top to bottom located at a point midway between the ends and also midway between the side edges of the board. One leg 41 of a T-shaped tubular fixture 42 is secured in hole 40. The lower end of the central member 38 of T-bar 16 extends into the leg 41 and is secured thereto by any suitable means, such as threading. The other leg 43 of the fixture 42 is secured to the bottom of the board 14.

A brace 50, of metal or any suitable relatively rigid material, extends between the uprights 20 and 22 near the bottom thereof, having its ends rigidly secured as by welding to the beams 28 of the two uprights midway between their ends. This brace is preferably of tubular construction.

The board 14 is urged to a neutral, generally horizontal position by an elastic member, preferably the strap 18. The strap 18 is an elongated, flexible, stretchable length of rubber or like elastic material. The strap is looped under brace 50. An S-shaped hook 52 extends through a hole in one end of strap 18, and a second S-shaped hook 54 extends through a hole in the other end of strap 18. The hooks 52 and 54 engage the ring 56 secured to leg 43 of fixture 42. The strap is at all times held in tension and urges the board to a neutral, generally horizontal position. The expression "elastic member" sometimes used herein, is intended to include a strap such as the rubber strap 18 as well as any member which will stretch when placed in tension and will return to its initial length when the tension is removed. A coil spring may be used. However, the rubber strap 18 is the preferred "elastic member". Other means may, of course, be substituted to urge the board to its neutral, generally horizontal position.

FIGS. 4 and 5 show a modification in which means for urging the board to a neutral, generally horizontal position are shown associated with a bearing sleeve 30 and the cross member 38 of T-bar 16. Such means comprises a strap 60 of the same rubber or like elastic material as strap 18, in ring form. The strap or ring 60 encircles the sleeve 30 and cross member 38 as shown, being bonded or otherwise secured at 62 at the top to the sleeve 30 and at 64 at the bottom to cross member 38. When the T-bar 16 is vertical as in FIG. 2, both sides of the ring 60 between the points of securement are under the same slight amount of tension. When the T-bar swings away from the vertical, the tension in one side of the ring increases and in the other side decreases, tending to return the T-bar to vertical and the board to horizontal position. A similar elastic ring 60 is preferably attached to the other sleeve 30 and to the other end portion of cross member 38. The modification of FIGS. 4 and 5 can be used to supplement the strap 18 or as a substitute therefor.

The glider may be used by two children seated on opposite ends of the board, or by one child alone seated on one end of the board. Even with only one child seated on the board, the strap 18 has enough tension to urge the board back towards a neutral, generally horizontal position.

What is claimed is:

1. A glider especially for children, comprising a supporting frame having laterally spaced apart uprights which together provide a ground-engaging base, an elongated board between said uprights having a seat portion at each end, means suspending said board from the upper end portions of said uprights for swinging movement in a vertical plane in opposite directions from a generally horizontal position, and means urging said board to said generally horizontal position.

2. A glider as defined in claim 1, wherein said suspending means comprises a T-bar having a horizontal cross member the ends of which are pivotally connected to the upper end portions of said respective uprights, said T-bar having a central member extending from said cross member at right angles thereto, and means connecting said central member to said board approximately midway between the ends thereof.

3. A glider as defined in claim 2, wherein said uprights have bearings at the upper ends thereof engaging said ends of said cross member to provide said pivotal connection.

4. A glider as defined in claim 2, wherein said uprights have aligned bearing sleeves at the upper ends thereof receiving the ends of said cross member to provide said pivotal connection.

5. A glider as defined in claim 1, wherein a brace is provided connecting the lower ends of said uprights, and said means urging said board to a generally horizontal position comprises an elongated, stretchable elastic member connected to said brace and to said board.

6. A glider as defined in claim 5, wherein said elastic member is a rubber strap.

7. A glider as defined in claim 1, wherein each upright has a pair of legs which are spaced apart at the bottoms and a beam connecting the bottom portions of said legs, a brace connecting said beams, and said means urging said board to said generally horizontal position comprises an elongated, stretchable elastic member looped under said brace and having the ends thereof connected to said board.

8. A glider especially for children, comprising a supporting frame having laterally spaced apart A-frame uprights, said uprights being disposed in parallel, generally vertical planes and each comprising a pair of legs connected at the tops, said legs diverging downwardly from the tops so as to be spaced apart at the bottoms, the bottoms of said legs being engageable with the ground to provide a base, an elongated rider board between said uprights having a seat portion at each end, means suspending said board from said supporting frame for swinging movement in a vertical plane generally parallel to the planes of said uprights in opposite directions from a generally horizontal position comprising a T-bar, aligned bearing sleeves at said tops of the legs of said uprights defining a horizontal pivot axis, said T-bar having a horizontal cross member the ends of which are received in said respective bearing sleeves for turning movement about the pivot axis of said bearing sleeves, said T-bar having a central member extending from the midpoint of said cross member at right angles thereto, means connecting said central member to said board approximately midway between the ends thereof, a beam connecting the bottoms of the legs of each upright, a brace connecting said beams, and means urging said board to said generally horizontal position including an elongated, stretchable elastic member looped under said brace and having the ends thereof connected to said board adjacent the midpoint in the length of the latter.

9. A glider as defined in claim 8, wherein said board has a handle near each end adjacent a said seat portion thereof.

10. A glider as defined in claim 9, wherein said elastic member is a rubber strap.

11. A glider as defined in claim 8, wherein said means for urging said board to a generally horizontal position also includes elastic members connected to said cross member of said T-bar and to said bearing sleeves.

12. A glider as defined in claim 3, wherein said means urging said board to a generally horizontal position comprises elastic means connected to at least one of said bearings and to said T-bar.

* * * * *